United States Patent [19]

Trini Castelli

[11] Patent Number: 4,701,831

[45] Date of Patent: Oct. 20, 1987

[54] METHOD OF LIGHTING ENVIRONMENTS IN GENERAL, PARTICULARLY OPEN SPACE ENVIRONMENTS

[76] Inventor: Clino Trini Castelli, Via Tivoli, 8 2121 Milan, Italy

[21] Appl. No.: 838,843

[22] Filed: Mar. 12, 1986

[30] Foreign Application Priority Data

Mar. 12, 1985 [IT] Italy ..... 19859 A/85

[51] Int. Cl.[4] ..... F21S 1/02; F21V 5/00

[52] U.S. Cl. ..... 362/147; 362/327; 362/299; 362/309

[58] Field of Search ..... 362/292, 297, 296, 305, 362/343, 346, 347, 327, 350, 1, 33, 228, 241, 299; 350/612, 613, 618, 619, 620, 602, 629

[56] References Cited

U.S. PATENT DOCUMENTS

| | | | |
|---|---|---|---|
| 3,239,660 | 3/1966 | Hall, Jr. | 362/1 |
| 3,247,367 | 4/1966 | Rayces | 362/1 |
| 3,296,432 | 1/1967 | Vantine | 362/1 |

*Primary Examiner*—Raymond A. Nelli

*Attorney, Agent, or Firm*—Sughrue, Mion, Zinn, Macpeak and Seas

[57] ABSTRACT

To lighten an open-space interior, use is made, as a light source, of a catadioptric reflective surface onto which one or more light beams are suitably directed to impinge.

5 Claims, 4 Drawing Figures

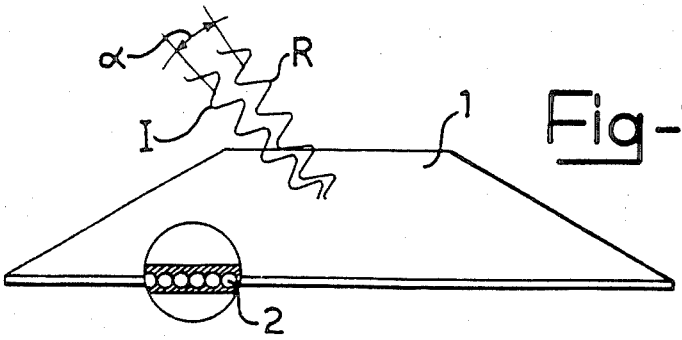
Fig-1
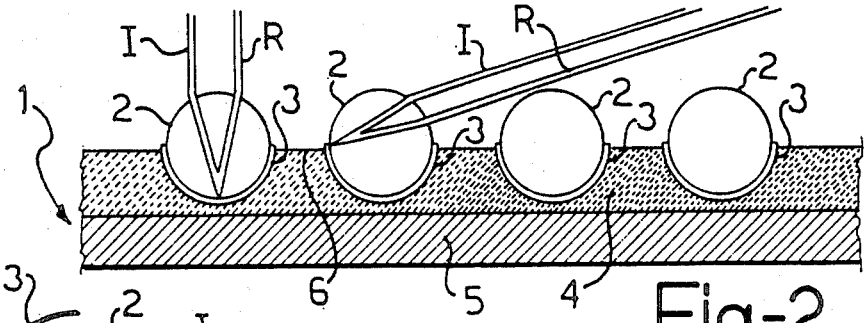
Fig-2
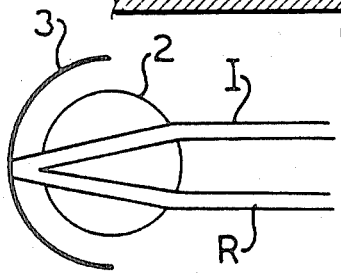
Fig-3
Fig-4
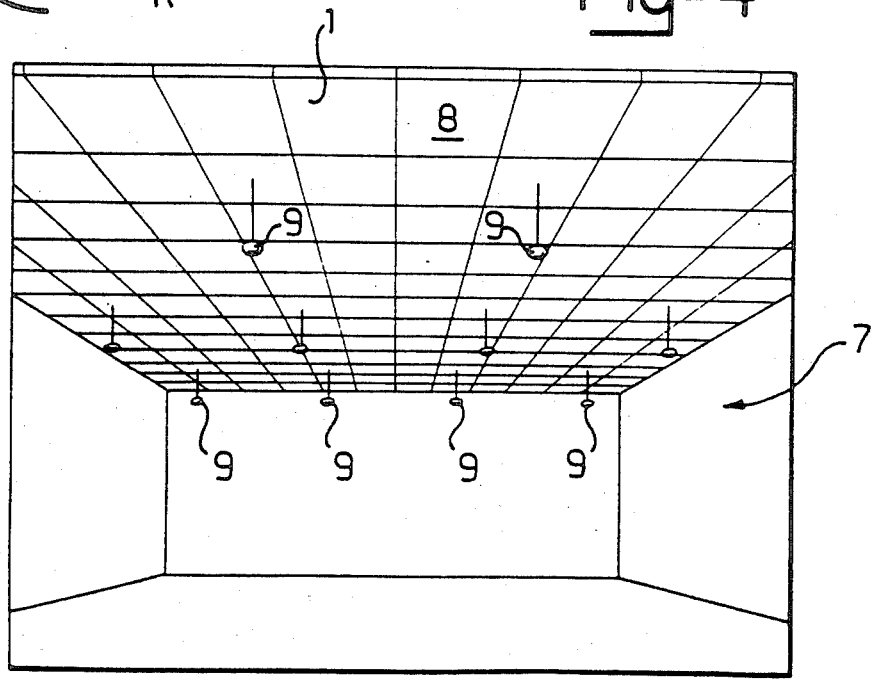

METHOD OF LIGHTING ENVIRONMENTS IN GENERAL, PARTICULARLY OPEN SPACE ENVIRONMENTS

This invention relates to a method of lightening generic interior spaces, in particular so-called open-space work interiors.

Well known is that there is a growing demand for a satisfactory solutionto the problem of correctly lightening work interiors of the above kind.

Also known is that the problem has varying contingent facets for which a priori solutions take on of necessity the character of compromises which get more or less close to the target optimum.

The problem is further aggravated by an open-space interior under consideration including, or being intended to include, work stations with video terminals or the like display apparatus. In such cases, in fact, the operators are commanded great visual attention, and the reflective nature inherent to display monitor construction imposes environmental lighting conditions of particular severity.

The ruling factors are in general the following:

Luminance differential between the display screen and the work surface

Optimum luminance distribution—which is always a highly important parameter in lighting engineering—is specially so with the interiors under consideration, both in respect of vertical lighting (which, for example, could affect certain files and personal relationships between operators) and of information reading. Comfortable reading of displayed information is dependent on contrast of characters, whose sharpness tends to fade away as the lighting intensity increases, thereby continued video work normally requires lighting below 300 lux. Definitely higher values, usually of some 500 lux, are instead required for good readibility of printed documents. The operator's eyes, in moving from the display screen to paper on the work surface, is stressed especially where the differential is too high. Thus, excessive luminance differences between elements of a given visual task are to be avoided.

Untoward reflections from the display screen

In view of the mirror-like behavior of a display screen, bright surfaces having a high luminance value and light sources are reflected on the screen to form light spots which disturb proper information reading. It becomes necessary, therefore, to arrange for the locations of such bright surfaces and light sources, and the distribution of light inflows, to discourage a situation of direct lighting of the screen.

Reflections from display screens have been subdued heretofore by employing direct lighting systems which incorporate suitably screened appliances to cut off any light emissions outside of a 45–55-degree angle, and indirect lighting systems.

With respect to the former, indirect lighting systems are recognized to afford the advantage of improved uniformity in lighting and higher lighting intensity in the vertical direction. However, they have the drawback of a comparatively lower lighting efficiency. This decreased efficiency is, however, more than compensated for by the possibility of using highly efficient light sources, at ratings which equal or are at least comparable to those of screened direct lighting systems.

It is generally recognized at present that the main cause for reflections of secondary light sources from display screens is the high and uncontrolled diffusive component also exhibited by direct lighting systems.

The problem underlying this invention is that of providing a novel method of lighting generic interiors, and in particular so-called open-space interiors including possible work stations with video terminals, indirectly, whereby the diffusive component of such illumination can be suppressed, while meeting all of the most up-to-date demands mentioned above, despite their varying with each case.

This problem is solved by a lighting method which is, according to the invention, characterized in that it consists of directing, in at least one direction, at least one light beam to impinge on a catadioptric reflective surface which forms then the lighting source for an interior space.

Implementation of this method has demonstrated full suppression capability of reflections from the screens of video terminals, perfect illumination capability in both the vertical and horizontal directions, and for that matter, a lighting efficiency which is the equal of or higher than that afforded by conventional type indirect lighting systems.

The novel lighting method of this invention is based essentially on the properties of catadioptric materials, and more specifically, on the "faults" or imperfections exhibited by such materials. In fact, it is well known that in the manufacture, for example, of the microballs that make up the surface layer of such catadioptric materials, it is unavoidable to introduce a range of imperfections which result in the reflected rays from the catadioptric surface showing a small angle of divergence with respect to the incident rays, and being, therefore, no longer cut off by the light source bodies.

The invention features and advantages will become apparent from the following description, to be read in conjunction with the accompanying drawings, where:

FIG. 1 shows diagramatically a catadioptric reflective surface employed in the method of this invention;

FIGS. 2 and 3 show diagramatically, to an enlarged scale, a detail of FIG. 1; and FIG. 4 shows diagramatically an open-space room lighted with the method of this invention.

Catadioptric reflection occurs where a light beam impinging on a catadioptric surface is sent by the surface back in the same direction from which it came. It is a very rare phenomenon to observe in nature, which occurs when the surface is made up of prismatic or spherical mircoelements. In that case, in fact, reflective and refractive phenomena are bound to occur in combination.

In the drawing Figures, the numeral 1 designates a catadioptric surface which is, preferably but not exclusively, formed from a catadioptric material comprising plural microballs 2 partially lagged by a thin hemispherical cap 3 of aluminum, and being bonded, by means of a bonding layer 4 composed of a suitable resin, to a fabric backing layer 5 or self-adhesive film, e.g. of polyethylene.

Indicated at I is an incident light beam or ray impinging on said catadioptric surface 1, and at R is the corresponding light beam reflected from said surface, between said beams there being formed a divergence angle generally in the 2° to 5° range.

The microballs 2 with their respective aluminum lagging 3 forming substantially a concave mirror operate as optical centers. Each of them behaves essentially as a double-convex lens, thereby the incident light beams undergo double refraction in passing through it. These beams are then reflected by the aluminum lagging 3 and, in passing again through the ball 2, subjected to an opposite refractive effect to the former which re-directs them toward the light source.

The backing 5 is of a grey color in order for it to absorb the light radiation impinging on the surface 1 by trapping it within its spaces 6 between microballs.

In a room 7 of the so-called open-space kind, which may accommodate work stations with video terminals (not shown), the ceiling 8 would be lined in part or throughout with the aforesaid catadioptric material.

A plurality of lamps 9, screened off in all directions except the ceiling 8, are installed in the open-space room in a properly distributed arrangement. The light beams radiating from all or some of said lamps 9, and impinging on the catadioptric surface, are reflected thereby (i.e. reflected back) throughout the room 7, for which the ceiling 8 will constitute an effective lighting source.

The lighting method of this invention might be referred to as a steered indirect lighting system.

The advantages afforded by this lighting method are all important:

the whole ceiling 8 is converted into an illuminating body effective to send light back to well-defined areas and to lighten the room 7 in a controlled fashion, to provide differentiated lighting levels therein;

by changing the layout of the lamps 9 (or some other light sources) it becomes possible to accurately adjust distribution of the light flow in relation to the video screens present and the work surfaces on which they stand;

differently from other forms of indirect lighting, wherein light is scattered in an uncontrolled fashion throughout a room, the ratio of the radiated light to the light actually available at a work surface is quite high, and high is accordingly the luminous efficiency of the system used to implement the inventive method;

there occur no spots of light on the display screens as a consequence of light spots formed on the ceiling and reflected on the screens;

the ceiling 8 shows up with a lower luminance than the illuminated objects present in the room 7, creating a condition which may be assimilated to that of natural light on a bright day; the feeling of an incumbent "sky", as brought about by an excessively glowing ceiling, is avoided;

in a room thus lighted, luminance constrast between adjoining areas is subdued to suppress formation of sharp shadows.

What is claimed is:

1. A method of lighting generic interiors and open-space work interiors comprising forming at least one surface of said interior as a catadioptric surface and directing at least one light beam on said catadioptric surface whereby the catadioptric surface is the lighting source for the interior.

2. An indirect lighting system for generic interiors and open-space work interiors, characterized in that it comprises a reflective catadioptric surface and a plurality of lamps arranged to direct their respective light beams to impinge on said surface.

3. A lighting system according to claim 1, characterized in that said lamps are screened off in all directions excepting toward said catadioptric surface.

4. A lighting system according to claim 2, characterized in that said catadioptric surface forms at least part of a wall in said interior.

5. A lighting system according to claim 4, characterized in that said catadioptric surface is the ceiling of said interior.

* * * * *